US011060522B2

(12) United States Patent
Morozumi

(10) Patent No.: US 11,060,522 B2
(45) Date of Patent: Jul. 13, 2021

(54) ROTARY COMPRESSOR HAVING REDUCED PRESSURE LOSS OF REFRIGERANT FLOW

(71) Applicant: FUJITSU GENERAL LIMITED, Kanagawa (JP)

(72) Inventor: Naoya Morozumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 223 days.

(21) Appl. No.: 16/329,894

(22) PCT Filed: Oct. 27, 2017

(86) PCT No.: PCT/JP2017/038969

§ 371 (c)(1),
(2) Date: Mar. 1, 2019

(87) PCT Pub. No.: WO2018/088253

PCT Pub. Date: May 17, 2018

(65) Prior Publication Data

US 2019/0211823 A1 Jul. 11, 2019

(30) Foreign Application Priority Data

Nov. 9, 2016 (JP) ..... JP2016-218844

(51) Int. Cl.

| | |
|---|---|
| ***F04C 18/344*** | (2006.01) |
| ***F04C 15/06*** | (2006.01) |
| ***F04C 18/356*** | (2006.01) |
| ***F01C 21/08*** | (2006.01) |
| ***F04C 23/00*** | (2006.01) |

(Continued)

(52) U.S. Cl.

CPC ..... *F04C 18/356* (2013.01); *F04C 18/3564* (2013.01); *F04C 23/008* (2013.01);

(Continued)

(58) Field of Classification Search

CPC .. F04C 18/356; F04C 18/3564; F04C 23/008; F04C 29/12; F04C 18/322;

(Continued)

(56) References Cited

U.S. PATENT DOCUMENTS 6,447,274 B1 * 9/2002 Horihata ..... F01C 21/104 29/888.025
2013/0280116 A1 * 10/2013 Hayashi ..... F04C 18/0215 418/55.2
2016/0333881 A1 * 11/2016 Nagasawa ..... F25B 31/023

FOREIGN PATENT DOCUMENTS

CN 101684812 A 3/2010
EP 2169230 A2 3/2010

(Continued)

OTHER PUBLICATIONS

Jul. 31, 2018, Japanese Decision to Grant a Patent issued for related JP Application No. 2016-218844.

(Continued)

*Primary Examiner* — Deming Wan

(74) *Attorney, Agent, or Firm* — Paratus Law Group, PLLC

(57) ABSTRACT

A suction passage includes: a first passage that is cylindrical and connected to a suction unit; and a second passage whose one end is connected to the first passage and other end has an opening on the inner circumference of a cylinder. The second passage is formed, from its one end to the other end, in a slit-like shape penetrating the upper side and the lower side of the cylinder, and satisfies L≥W1, W1≤D1×0.7, W2≤D1 where the width of the second passage at the other end in a circumferential direction of the cylinder is W1, the width of the second passage at the one end is W2, the length of the second passage from the one end to the other end is (Continued)

L, and the inner diameter of the first passage at an area connected to the second passage is D1.

5 Claims, 6 Drawing Sheets

(51) Int. Cl.
*F04C 29/12* (2006.01)
*F04C 18/02* (2006.01)
*F04C 18/32* (2006.01)

(52) U.S. Cl.
CPC ..... *F04C 29/12* (2013.01); *F04C 2240/30* (2013.01); *F04C 2250/101* (2013.01)

(58) Field of Classification Search
CPC ..... F04C 2250/10; F04C 2250/101; F04C 18/3442; F04C 15/06; F01C 21/08
See application file for complete search history.

(56) References Cited

FOREIGN PATENT DOCUMENTS

| | | | |
|---|---|---|---|
| JP | S61-034376 | A | 2/1986 |
| JP | S61-241490 | A | 10/1986 |
| JP | S62-101090 | U | 6/1987 |
| JP | H10-266984 | A | 10/1998 |
| JP | H11-141481 | A | 5/1999 |
| JP | 2001-280277 | A | 10/2001 |
| JP | 5879474 | B2 | 3/2016 |

OTHER PUBLICATIONS

Oct. 18, 2019, Chinese Office Action issued for related CN Application No. 201780051665.7.

* cited by examiner

ROTARY COMPRESSOR HAVING REDUCED PRESSURE LOSS OF REFRIGERANT FLOW

CROSS REFERENCE TO PRIOR APPLICATION

This application is a National Stage Patent Application of PCT International Patent Application No. PCT/JP2017/038969 (filed on Oct. 27, 2017) under 35 U.S.C. § 371, which claims priority to Japanese Patent Application No. 2016-218844 (filed on Nov. 9, 2016), which are all hereby incorporated by reference in their entirety.

TECHNICAL FIELD

The present invention relates to a rotary compressor.

BACKGROUND ART

In a rotary compressor, a refrigerant is suctioned into a circular cylinder through a cylindrical suction hole extending in a radial direction of the cylinder, and the refrigerant is compressed by a circular piston that is eccentrically rotated within the cylinder.

CITATION LIST

Patent Citation

Patent Literature 1: Japanese Laid-open Patent Publication No. 11-141481

Patent Literature 2: Japanese Patent No. 5879474

SUMMARY OF INVENTION

Technical Problem

FIG. 9 is a perspective view that illustrates the flow of a refrigerant when it is suctioned into a cylinder through a suction hole in a rotary compressor according to a related technology. As illustrated in FIG. 9, as a suction hole 203, which is provided in a cylinder 202, extends in the radial direction of the cylinder 202, the flow of the refrigerant in the suction hole 203 is a flow F1 in the radial direction of the cylinder 202. A circular opening 204 provided on the suction hole 203 and penetrating the inner circumference of the cylinder 202 causes the flow F1 of the refrigerant entering the cylinder 202 through the circular opening 204 to change into a flow including a flow F2 in the circumferential direction of the inner circumference of the cylinder 202 and a flow F3 in the vertical direction of the inner circumference of the cylinder 202 (the axial direction of the rotary shaft) due to the piston rotated within the cylinder 202. At this point, especially the refrigerant flowing in the vertical direction of the inner circumference of the cylinder 202 collides against end plates (including an intermediate divider in the case of a two-cylinder type rotary compressor) covering the upper side and the lower side of the cylinder 202, respectively, and the occurrence of a flow such as vortex interrupts the flow of the refrigerant in the circumferential direction of the cylinder 202, which results in the problem of a pressure loss in the refrigerant flowing into the cylinder 202.

There are known rotary compressors according to related technologies having a configuration in which, for example, a cutout portion having a circular shape in cross-section, is formed in the vertical direction of a cylinder at the edge of the opening of a suction hole on the inner circumference of the cylinder. The cutout portion widens the opening of the suction hole in the circumferential direction of the cylinder, thereby preventing rapid changes in the flow of the refrigerant in the vertical direction of the cylinder when the refrigerant enters the cylinder through the opening.

However, the above configuration of the cutout portion formed at the opening of the suction hole, is less effective in reducing the flow of the refrigerant in the vertical direction of the cylinder through the opening of the suction hole because the cutout portion is not deep in the radial direction of the cylinder (the radial direction of the rotary shaft), and therefore a pressure loss of the refrigerant is not sufficiently reduced.

The disclosed technology has been made in consideration of the foregoing, and it has an object to provide a rotary compressor that is capable of reducing a pressure loss that occurs when a refrigerant is suctioned into a cylinder.

Solution to Problem

According to an aspect of the embodiments, a rotary compressor includes: a longitudinally-mounted sealed cylindrical compressor chassis that is provided with a discharge unit for a refrigerant in an upper section thereof and provided with a suction unit for a refrigerant in a lower section thereof; a compression unit that is disposed in a lower section of the compressor chassis to compress the refrigerant suctioned from the suction unit and discharge the refrigerant through the discharge unit; and a motor that is disposed in an upper section of the compressor chassis to drive the compression unit, the compression unit including a circular cylinder; end plates that cover an upper side and a lower side of the cylinder, respectively; a rotary shaft that includes an eccentric portion and that is rotated by the motor; a piston that is engaged with the eccentric portion and orbitally moved along an inner circumference of the cylinder to form a cylinder chamber in the cylinder; a vane that protrudes from a vane groove provided in the cylinder into the cylinder chamber and that is brought into contact with the piston to divide the cylinder chamber into a suction chamber and a compression chamber; and a suction passage for a refrigerant, which is provided in the cylinder by extending in a radial direction of the cylinder and which communicates with the suction unit, the suction passage includes a first passage that is cylindrical and connected to the suction unit; and a second passage whose one end is connected to the first passage and other end has an opening on the inner circumference of the cylinder, and the second passage is formed, from the one end to the other end, in a slit-like shape penetrating an upper side and a lower side of the cylinder, and satisfies $L \geq W1$, $W1 \leq D1 \times 0.7$, $W2 \leq D1$ where a width of the second passage at the other end in a circumferential direction of the cylinder is W1, the width of the second passage at the one end is W2, a length of the second passage from the one end to the other end is L, and an inner diameter of the first passage at an area connected to the second passage is D1.

Advantageous Effects of Invention

According to an aspect of a rotary compressor disclosed in the subject application, it is possible to reduce a pressure loss that occurs when a refrigerant is suctioned into a cylinder.

EMBODIMENTS FOR CARRYING OUT THE INVENTION

With reference to drawings, an embodiment of a rotary compressor disclosed in the subject application, is explained in detail below. The rotary compressor disclosed in the subject application is not limited to the embodiment described below.

[Embodiment]

(Configuration of Rotary Compressor)

Figure 1:
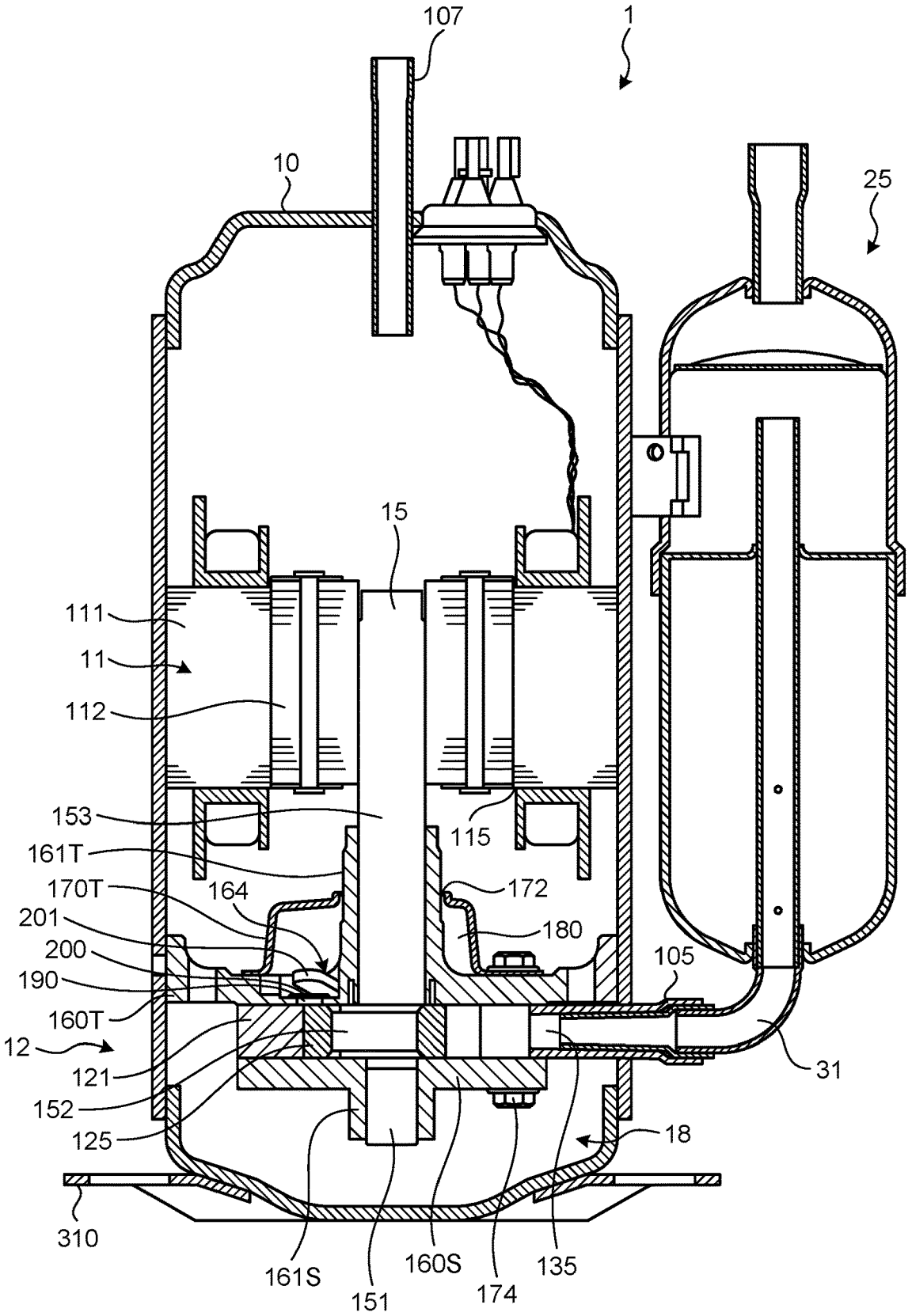
FIG. 1 is a longitudinal sectional view that illustrates a rotary compressor according to an embodiment.
Figure 2:
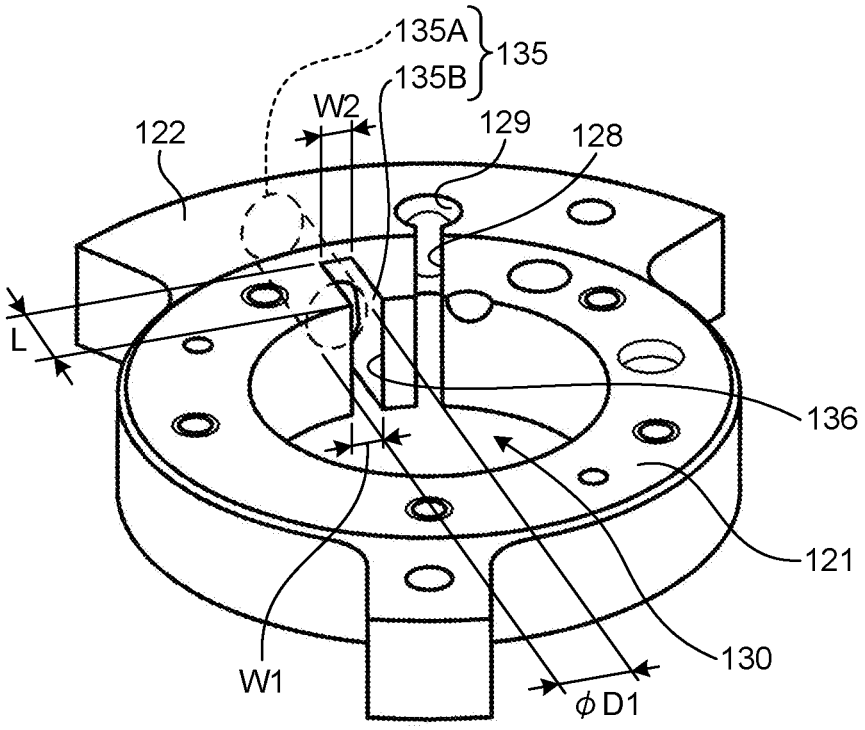
FIG. 2 is a perspective view that illustrates, from above, a compression unit in the rotary compressor according to the embodiment.
Figure 3A:
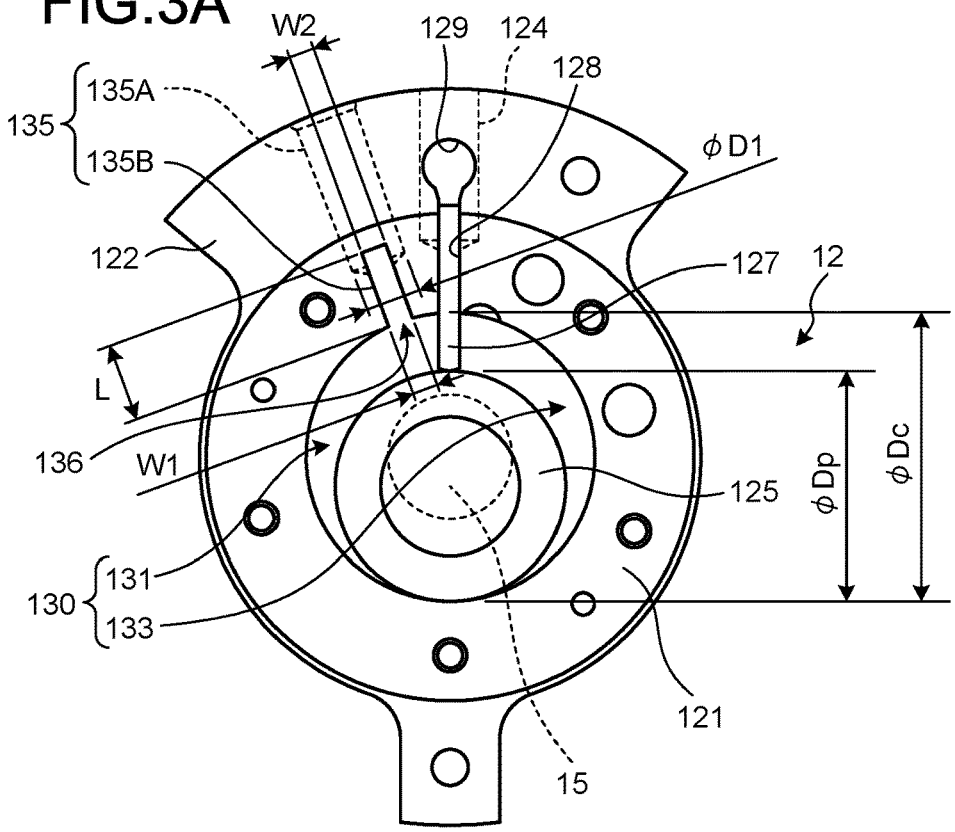
FIG. 3A is a plan view that illustrates, from above, a cylinder, a piston, and a vane in the rotary compressor according to the embodiment.
Figure 3B:
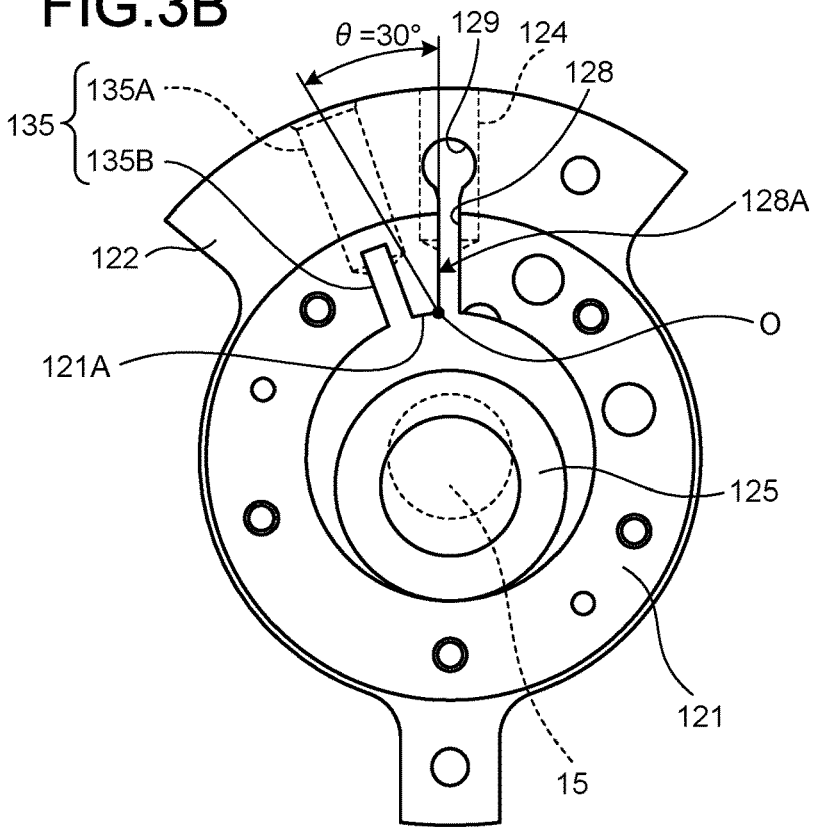
FIG. 3B is a plan view that illustrates the positional relationship between a vane groove and a suction passage in the rotary compressor according to the embodiment.

FIG. 1 is a longitudinal sectional view that illustrates a rotary compressor according to an embodiment. FIG. 2 is a perspective view that illustrates a compression unit in the rotary compressor according to the embodiment. FIG. 3A is a plan view that illustrates, from above, a cylinder, a piston, and a vane in the rotary compressor according to the embodiment. FIG. 3B is a plan view that illustrates the positional relationship between a vane groove and a suction passage in the rotary compressor according to the embodiment.

As illustrated in FIG. 1, a rotary compressor 1 includes: a compression unit 12 disposed in a lower section of a longitudinally-mounted sealed cylindrical compressor chassis 10; a motor 11 that is disposed in an upper section of the compressor chassis 10 to drive the compression unit 12 via a rotary shaft 15; and a longitudinally-mounted sealed cylindrical accumulator 25 that is secured to the outer circumference of the compressor chassis 10.

The accumulator 25 is coupled to a cylinder chamber 130 (see FIG. 2) of a cylinder 121 via a suction tube 105 serving as a suction unit and an accumulator curved tube 31.

The motor 11 includes: a stator 111 that is disposed on the outer side; and a rotor 112 that is disposed on the inner side. The stator 111 is secured to the inner circumference of the compressor chassis 10 in a state of shrink-fitting. The rotor 112 is secured to the rotary shaft 15 in a state of shrink-fitting.

A sub-shaft portion 151 under an eccentric portion 152 is rotatably supported by a sub-shaft bearing portion 161S provided in a lower end plate 160S, a main shaft portion 153 above the eccentric portion 152 is rotatably supported by a main-shaft bearing portion 161T provided in an upper end plate 160T, and a piston 125 is supported by the eccentric portion 152 so that the rotary shaft 15 is rotatably supported by the entire compression unit 12 and the rotation causes the orbital movement of the piston 125 along the inner circumference of the cylinder 121.

The inside of the compressor chassis 10 is filled with the amount of lubricant oil 18 enough to almost dip the compression unit 12 therein so as to ensure the lubricating property of a sliding unit, such as the piston 125, which slides in the compression unit 12, and to seal a compression chamber 133 (see FIG. 3A). On the lower side of the compressor chassis 10, an attachment leg 310 (see FIG. 1) is fixed to lock multiple elastic support members (not illustrated) that support the entire rotary compressor 1.

As illustrated in FIG. 1, the compression unit 12 compresses the refrigerant, which is suctioned through the suction tube 105, and discharges it through a discharge tube 107, described later, serving as a discharge unit. The compression unit 12 is configured by stacking, from the top, an upper-end plate cover 170T having a bulging portion with a hollow space formed therein; the upper end plate 160T; the circular cylinder 121; and the lower end plate 160S. The entire compression unit 12 is fixed from the top to the bottom with multiple through bolts 174 and an auxiliary bolt (not illustrated), which are arranged in substantially a concentric fashion. An upper-end plate cover chamber 180 is formed between the upper end plate 160T and the upper-end plate cover 170T having the bulging portion, being tightly fixed to each other.

As illustrated in FIGS. 3A and 3B, the cylinder 121 is provided with an inner circumference that is concentric with respect to the rotary shaft 15 of the motor 11. The piston 125, which has an outer diameter smaller than the inner diameter of the cylinder 121, is provided on the inner side of the inner circumference of the cylinder 121, and the cylinder chamber 130 is formed between the inner circumference of the cylinder 121 and the outer circumference of the piston 125 to suction, compress, and discharge the refrigerant.

As illustrated in FIGS. 2, 3A, and 3B, the cylinder 121 includes a lateral projection portion 122 that projects from the circular outer circumference in the radial direction of the cylinder 121 (the radial direction of the rotary shaft 15). The lateral projection portion 122 is formed on a predetermined projection area in the circumferential direction of the rotary shaft 15. The lateral projection portion 122 is used as a hold portion for chuck to fix the cylinder 121 to a processing jig when the cylinder 121 is processed.

The lateral projection portion 122 is provided with a vane groove 128 radially extending from the wall surface of the cylinder chamber 130 to the outer circumference side of the cylinder 121. Within the vane groove 128, a plate-like vane 127 is provided such that it is slidable in the radial direction of the cylinder 121. In the lateral projection portion 122, a spring hole 124 from the outer circumference of the lateral projection portion 122, is provided at the position overlapped with the vane groove 128 in such a depth that it does not penetrate into the cylinder chamber 130. The spring hole 124 is provided with a spring (not illustrated) for biasing the vane 127.

Furthermore, the cylinder 121 is provided with a pressure introduction passage 129, which introduces the compressed refrigerant in the compressor chassis 10 with an opening section communicating between the outside of the vane groove 128 in a radial direction and the inside of the compressor chassis 10 and which applies a back pressure to the vane 127 due to the pressure of the refrigerant.

As illustrated in FIG. 3A, when the vane 127 is pressed by the spring and is brought into contact with the outer circumference of the piston 125, the cylinder chamber 130 is divided into a suction chamber 131, which communicates with a suction passage 135, and into the compression chamber 133, which communicates with a discharge hole 190 provided in the upper end plate 160T. The upper side of the cylinder chamber 130 in the axial direction of the rotary shaft 15 is closed by the upper end plate 160T, and the lower side thereof is closed by the lower end plate 160S.

Furthermore, as illustrated in FIGS. 1, 2, 3A, and 3B, the lateral projection portion 122 of the cylinder 121 is provided with the suction passage 135, which is coupled to the suction tube 105 and which extends in the radial direction of the cylinder 121 (the radial direction of the rotary shaft 15). Details of the suction passage 135, which is the feature of the present invention, are given later.

As illustrated in FIG. 1, the upper end plate 160T is provided with the discharge hole 190, which penetrates the upper end plate 160T and which communicates with the compression chamber 133 of the cylinder 121. The discharge hole 190 is provided near the vane groove 128. After being compressed in the compression chamber 133, the refrigerant is discharged into the compressor chassis 10 from the compression chamber 133 through the discharge hole 190. At the exit side of the discharge hole 190, an upper valve seat (not illustrated) is formed around the discharge hole 190. On the upper end plate 160T, a discharge-valve housing recessed portion 164 is formed, extending like a groove from the position of the discharge hole 190 toward the outer circumference of the upper end plate 160T.

The discharge-valve housing recessed portion 164 houses: a discharge valve 200 of a reed valve type whose trailing edge is fixed by a rivet (not illustrated) within the discharge-valve housing recessed portion 164 and leading edge opens and closes the discharge hole 190; and an entire discharge-valve presser 201 whose trailing edge is fixed by the rivet within the discharge-valve housing recessed portion 164 in an overlapped manner with the discharge valve 200 and leading edge is curved (distorted) in a direction to open the discharge valve 200 so as to control the opening degree of the discharge valve 200.

The flow of the refrigerant due to rotation of the rotary shaft 15, is explained below. In the cylinder chamber 130, rotation of the rotary shaft 15 causes orbital movement of the piston 125 that is engaged with the eccentric portion 152 of the rotary shaft 15, along the inner circumference of the cylinder 121 so that the suction chamber 131 suctions the refrigerant through the suction tube 105 while its volume is increased and the compression chamber 133 compresses the refrigerant while its volume is reduced, and when the pressure of the compressed refrigerant becomes higher than the pressure in the upper-end plate cover chamber 180 outside the discharge valve 200, the discharge valve 200 is opened so that the refrigerant is discharged from the compression chamber 133 to the upper-end plate cover chamber 180. After being discharged to the upper-end plate cover chamber 180, the refrigerant is discharged into the compressor chassis 10 through an upper-end plate cover discharge hole 172 (see FIG. 1), which is provided in the upper-end plate cover 170T.

After being discharged into the compressor chassis 10, the refrigerant is guided to the upper side of the motor 11 through a cutout (not illustrated), which is provided on the outer circumference of the stator 111 and which communicates in a vertical direction, the gap (not illustrated) between windings of the stator 111, or a gap 115 (see FIG. 1) between the stator 111 and the rotor 112, and it is discharged through the discharge tube 107 serving as a discharge unit, which is disposed in the upper section of the compressor chassis 10.

(Characteristic Configuration of the Rotary Compressor)

Next, the characteristic configuration of the rotary compressor 1 according to the embodiment, is explained. As illustrated in FIGS. 2, 3A, and 3B, the suction passage 135 of the cylinder 121 according to the embodiment includes: a first passage 135A that is cylindrical and connected to the suction tube 105 serving as the suction unit; and a second passage 135B whose one end is connected to the first passage 135A and other end is an opening formed on the inner circumference of the cylinder 121. The first passage 135A and the second passage 135B extend in a radial direction of the cylinder 121.

The second passage 135B is formed, from its one end to the other end, in a slit-like shape penetrating the upper edge surface and the lower edge surface of the cylinder 121. That is, the entire second passage 135B penetrates in the vertical direction of the cylinder 121 (the axial direction of the rotary shaft 15). The width of the second passage 135B from its one end to the other end in the circumferential direction of the cylinder 121, is identical, that is, it is formed to be straight with the identical width in the radial direction of the cylinder 121 (W1=W2). Therefore, the other end of the second passage 135B has a rectangular opening 136, which is on the inner circumference of the cylinder 121 and which continues between the upper end plate 160T and the lower end plate 160S.

Furthermore, the second passage 135B satisfies $$L \geq W1 \quad \text{(Equation 1)}$$

where its width at the other end in the circumferential direction of the cylinder 121 is W1 and the length of the second passage 135B from one end to the other end is L.

Furthermore, $$W1 \leq D1 \times 0.7 \quad \text{(Equation 2)}$$

is satisfied where the inner diameter (diameter) of the first passage 135A is D1. Moreover, it is appropriate as long as the inner diameter D1 of the first passage 135A at the area connected to the second passage 135B satisfies Equation 2.

Furthermore, the width W2 of the second passage 135B at one end (at the side of the first passage 135A) satisfies $$W2 \leq D1 \quad \text{(Equation 3)}$$

Furthermore, as illustrated in FIG. 3A, the width W1 of the second passage 135B at the other end satisfies $$[(Dc-Dp)\times 0.3] \leq W1 \leq [(Dc-Dp)\times 0.7] \quad \text{(Equation 4)}$$

where the inner diameter of the inner circumference of the cylinder 121 is Dc, and the outer diameter of the outer circumference of the piston 125 is Dp.

Furthermore, as illustrated in FIG. 3B, the second passage 135B is formed at a position away from a side surface 128A of the vane groove 128 at the side of the suction passage 135 toward the suction passage 135 with a central angle θ of equal to or more than 30° with the intersection point between the side surface 128A and an inner circumference 121A of the cylinder 121 as a center O on the plane perpendicular to the axial direction of the rotary shaft 15. In other words, the second passage 135B is disposed such that it is not overlapped with a fan-like area with the central angle θ of 30° around the center O on the plane perpendicular to the axial direction of the rotary shaft 15.

Figure 4:
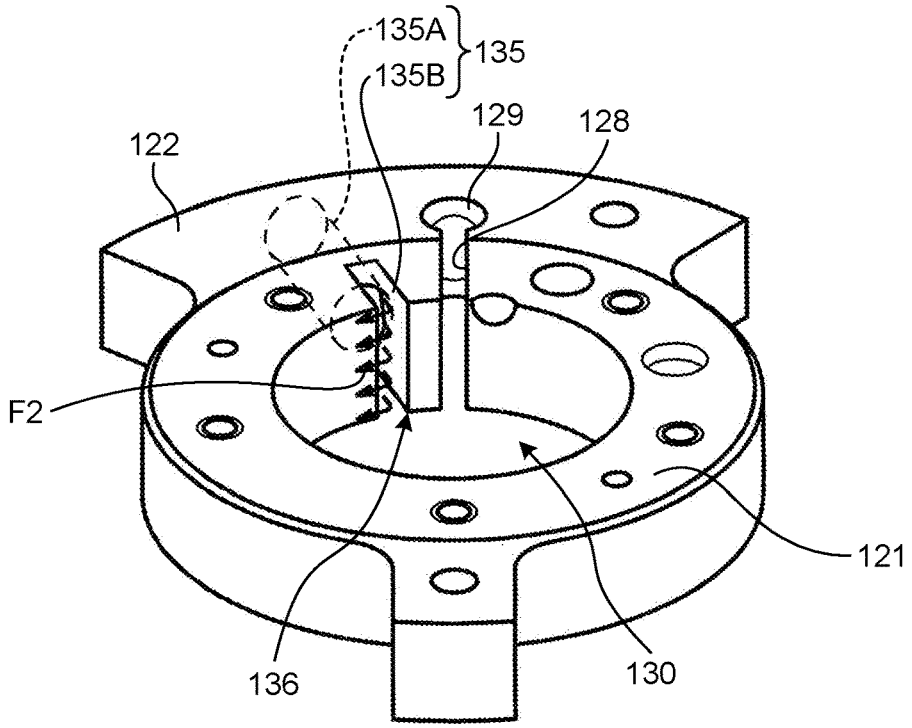
FIG. 4 is a perspective view that illustrates the flow of a refrigerant when it is suctioned into a cylinder through the suction passage in the rotary compressor according to the embodiment.

With regard to the rotary compressor 1 with the above configuration according to the embodiment, an explanation is given of the flow of the refrigerant within the cylinder 121 and an advantage of the present embodiment. FIG. 4 is a perspective view that illustrates the flow of the refrigerant when it is suctioned into the suction chamber 131 through the suction passage 135 in the rotary compressor 1 according to the embodiment.

In the rotary compressor 1 according to the embodiment, when the refrigerant is suctioned into the suction chamber 131 through the suction passage 135, the refrigerant flows from the first passage 135A of the suction passage 135 to the second passage 135B so that the flow of the refrigerant in the second passage 135B previously spread in the vertical direction of the cylinder 121 (the axial direction of the rotary shaft 15), and it is aligned and flows within the second passage 135B along the upper end plate 160T and the lower end plate 160S. This prevents the occurrence of flow of the refrigerant at the edge of the opening 136 in the vertical direction of the inner circumference of the cylinder 121 when the refrigerant is suctioned into the suction chamber 131 through the opening 136 of the second passage 135B, as illustrated in FIG. 4, whereby the flow F2 is generated in the circumferential direction of the inner circumference of the cylinder 121 through the opening 136 of the second passage 135B.

Thus, the second passage 135B, which penetrates in the vertical direction of the cylinder 121, prevents the occurrence of flow of the refrigerant at the edge of the opening 136 of the second passage 135B in the vertical direction of the inner circumference of the cylinder 121, thereby preventing blocking of the flow of the refrigerant in the circumferential direction of the inner circumference of the cylinder 121, reducing the occurrence of a pressure loss of the refrigerant at the edge of the opening 136, and improving the compression efficiency of the rotary compressor 1.

Furthermore, in the rotary compressor 1, as the change rate in the volume of the suction chamber 131 during one revolution of the piston 125 is largely different, the flow velocity of the refrigerant flowing through the suction passage 135 largely changes during one revolution of the piston 125. Particularly, during high-speed revolution, the inertia force (momentum) of the refrigerant flowing through the suction passage 135 causes the phenomenon of supercharging in which the pressure in the suction chamber 131 is higher than the pressure in the suction passage 135, and the phenomenon of supercharging produces an advantage such as an improvement in the circulation flow rate of the refrigerant.

However, when the refrigerant has been completely suctioned into the suction chamber 131, the low change rate in the volume of the suction chamber 131 and the low flow velocity of the refrigerant, cause the refrigerant supercharged into the suction chamber 131 to temporarily flow back toward the suction passage 135 in the middle of being suctioned into the suction chamber 131 through the suction passage 135.

The opening width of the opening 136 of the second passage 135B in the suction passage 135 in the circumferential direction of the cylinder chamber 130, is narrower than that of the opening when the cylindrical first passage 135A with the inner diameter D1 is extended to the inner circumference of the cylinder 121. Due to the narrow opening width, the position of the opening edge (the corner connecting the inner circumference of the cylinder 121 and the second passage 135B) of the opening 136 of the second passage 135B in the circumferential direction of the cylinder 121, is far from the back position in the circumferential direction of the suction chamber 131, i.e., the position where the outer circumference of the piston 125 slides with the inner circumference of the cylinder 121. Thus, this prevents the refrigerant suctioned into the suction chamber 131 from being hit and returned by the back position in the circumferential direction of the suction chamber 131 and flowing back from the suction chamber 131 to the suction passage 135 through the opening 136 when the refrigerant has been completely suctioned into the suction chamber 131.

Furthermore, the small opening area of the opening 136 of the second passage 135B in the suction passage 135 with respect to the flow amount of the refrigerant, causes the high resistance of flow into the suction chamber 131 and causes the occurrence of a pressure loss. Conversely, the large opening area of the opening 136 in the suction passage 135 communicating with the suction chamber 131, increases the amount of refrigerant flowing back toward the suction passage 135 after being supercharged into the suction chamber 131, and therefore the above-described advantage, an improvement in the circulation flow rate of the refrigerant, is canceled out. Therefore, the opening area of the opening 136 of the second passage 135B needs to be set in the range of appropriate dimension to prevent flow-back of the refrigerant supercharged into the suction chamber 131 as well as it is set to be large to reduce the resistance of flow into the suction chamber 131.

The width W1 of the second passage 135B penetrating in the vertical direction of the cylinder 121 (the axial direction of the rotary shaft 15), is made appropriate by satisfying Equation 4 so that it is possible to reduce the pressure loss occurring when the refrigerant is suctioned into the suction chamber 131 through the second passage 135B, and to reduce the amount of refrigerant flowing back to the suction passage 135 when the refrigerant is temporarily supercharged into the suction chamber 131 in the middle of being suctioned into the cylinder 121, whereby the compression efficiency of the rotary compressor 1 may be improved.

As described above, the suction passage 135 included in the rotary compressor 1 according to the embodiment includes, the first passage 135A and the slit-like second passage 135B, and the second passage 135B satisfies $L \geq W1$, $W1 \leq D1 \times 0.7$, and $W2 \leq D1$. This prevents disturbance of the flow of a refrigerant in the second passage 135B and also prevents the occurrence of flow of a refrigerant in the vertical direction of the inner circumference of the cylinder 121 when the refrigerant is suctioned into the suction chamber 131 through the second passage 135B, whereby a pressure loss in the flow of the refrigerant suctioned into the suction chamber 131, may be reduced. Furthermore, the amount of refrigerant flowing back and returning to the suction passage 135 after being suctioned into the suction chamber 131 once may be effectively reduced. Thus, the compression efficiency of the rotary compressor 1 may be improved.

Furthermore, in the rotary compressor 1 according to the embodiment, when the width W1 of the second passage 135B at the other end is $W1 \leq [(Dc-Dp) \times 0.3]$ where the inner diameter of the cylinder 121 is Dc, and the outer diameter of the piston 125 is Dp, a pressure loss in the flow of the refrigerant in the second passage is large, and when $W1 \geq [(Dc-Dp) \times 0.7]$, a large amount of refrigerant flows back and returns to the suction passage 135 after being suctioned into the suction chamber 131 once. Thus, as $[(Dc-Dp) \times 0.3] \leq W1 \leq [(Dc-Dp) \times 0.7]$ is satisfied, the width W1 of the second passage 135B is made appropriate so that it is possible to effectively reduce a pressure loss in the flow of a refrigerant suctioned into the suction chamber 131, and to reduce the amount of refrigerant flowing back to the suction passage 135 when the refrigerant is temporarily supercharged into the suction chamber 131 in the middle of being suctioned into the cylinder 121, whereby the compression efficiency of the rotary compressor 1 may be improved.

Generally, in the rotary compressor 1, as the pressure in the compression chamber 133 is higher than the pressure in the suction chamber 131, a pressure difference between the compression chamber 133 and the suction chamber 131, tends to cause the vane 127 to be pushed toward the suction chamber 131. Here, the side surface 128A of the vane groove 128, supporting the vane 127 pushed toward the suction chamber 131 due to the pressure difference, at the side of the suction passage 135 is pushed by the vane 127. Therefore, a reduction in the thickness of the area between the slit-like second passage 135B, which penetrates in the vertical direction of the cylinder 121, and the vane groove 128, may cause the rotary compressor 1 to be damaged in operation.

Furthermore, the vane groove 128 has a high demand for the processing accuracy for the width dimension in the circumferential direction of the cylinder 121 and the surface roughness of side surfaces; therefore, during typical processing steps for the cylinder 121, finish processing on the vane groove 128 is performed at a step after cutting processing on the second passage 135B. For this reason, a reduction in the thickness of the area between the slit-like second passage 135B, which penetrates in the vertical direction of the cylinder 121, and the vane groove 128, causes deformation of the area during finish processing on the vane groove 128, and leakage of the refrigerant due to a decrease in the accuracy of the width dimension of the vane groove 128 and an increase in the slide loss due to a reduction in surface roughness, cause a reduction in the compression efficiency of the rotary compressor 1.

In the rotary compressor 1 according to the embodiment, the second passage 135B is formed at a position away from the side surface 128A of the vane groove 128 at the side of the suction passage 135 toward the suction passage 135 with the central angle θ of equal to or more than 30° with the intersection point between the side surface 128A and the inner circumference 121A of the cylinder 121 as the center O on the plane perpendicular to the axial direction of the rotary shaft 15. This allows the cylinder 121 to ensure an appropriate thickness between the vane groove 128 and the second passage 135B in the circumferential direction of the cylinder 121. Therefore, it is possible to ensure an appropriate mechanical strength of the area between the vane groove 128 and the second passage 135B in the cylinder 121, ensure an appropriate processing accuracy of the width dimension of the vane groove 128 and surface roughness by conducting appropriate finish processing on the vane groove 128, thereby preventing a reduction in the compression efficiency of the rotary compressor 1.

A modification is explained below with reference to drawings. In a modification, the same component as that in the embodiment is attached with the same reference numeral as that in the embodiment, and explanation is omitted.

Figure 5:
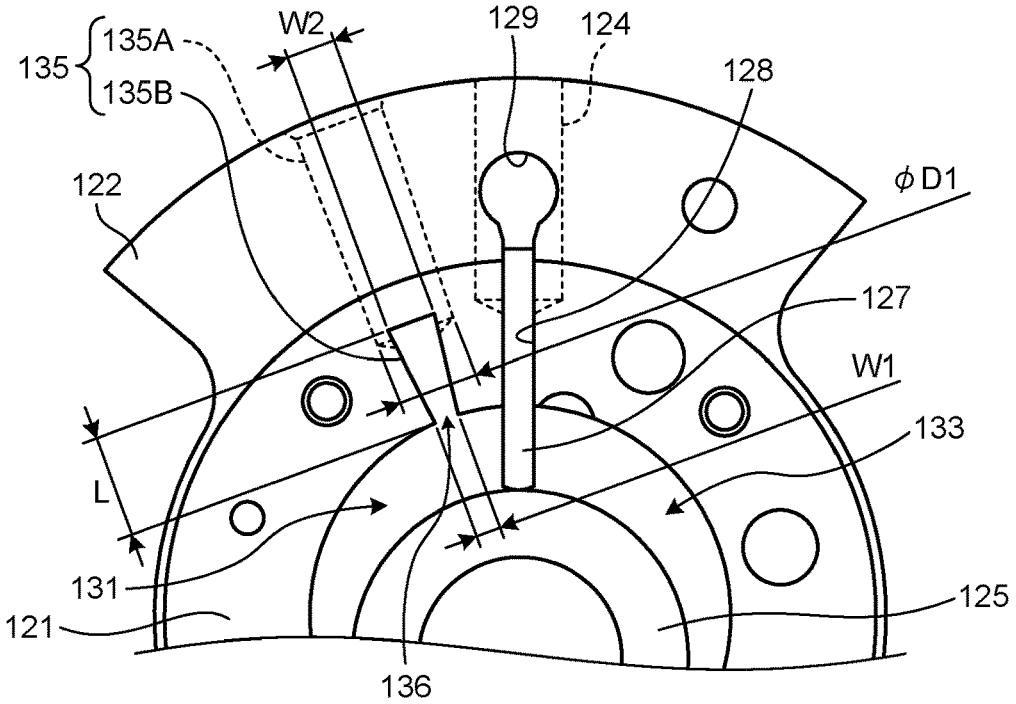
FIG. 5 is a plan view that illustrates, from above, a cylinder, a piston, and a vane in a rotary compressor according to a modification 1.
Figure 6:
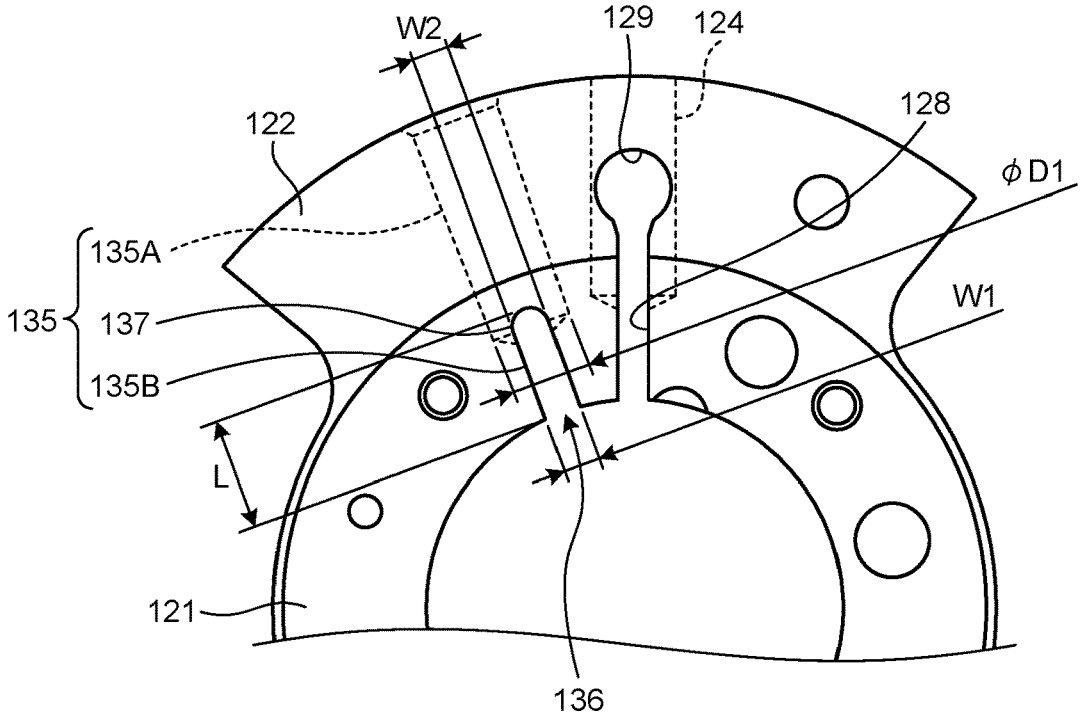
FIG. 6 is a plan view that illustrates, from above, the cylinder, the piston, and the vane in a rotary compressor according to a modification 2.
Figure 7:
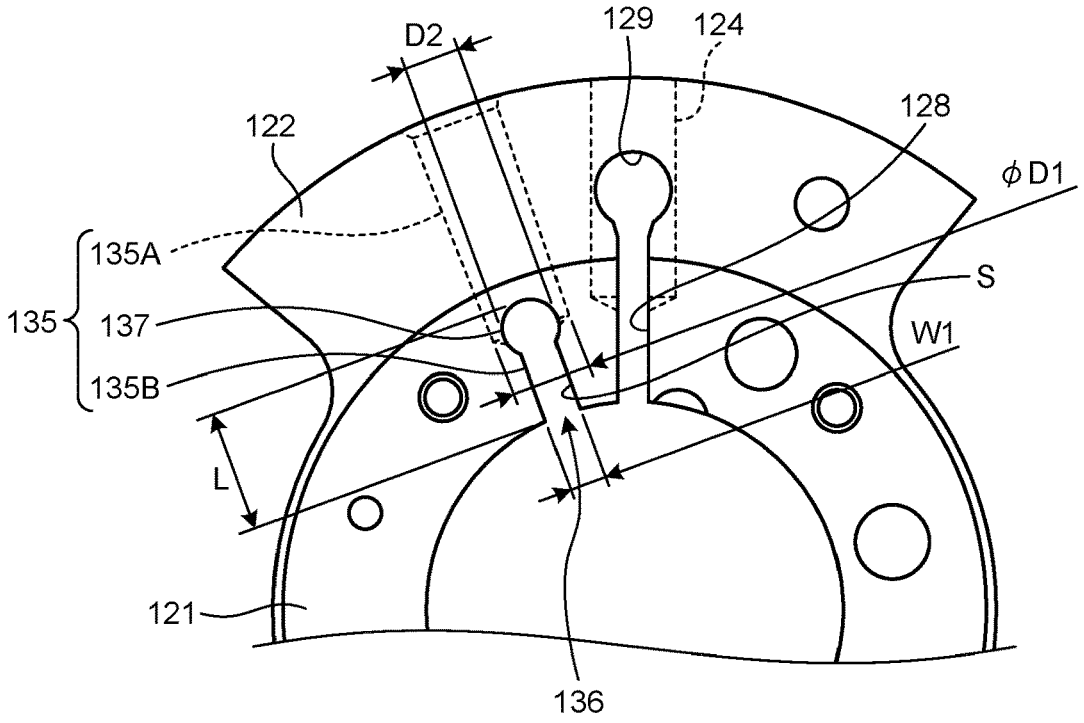
FIG. 7 is a plan view that illustrates, from above, the cylinder, the piston, and the vane in a rotary compressor according to a modification 3.
Figure 8:
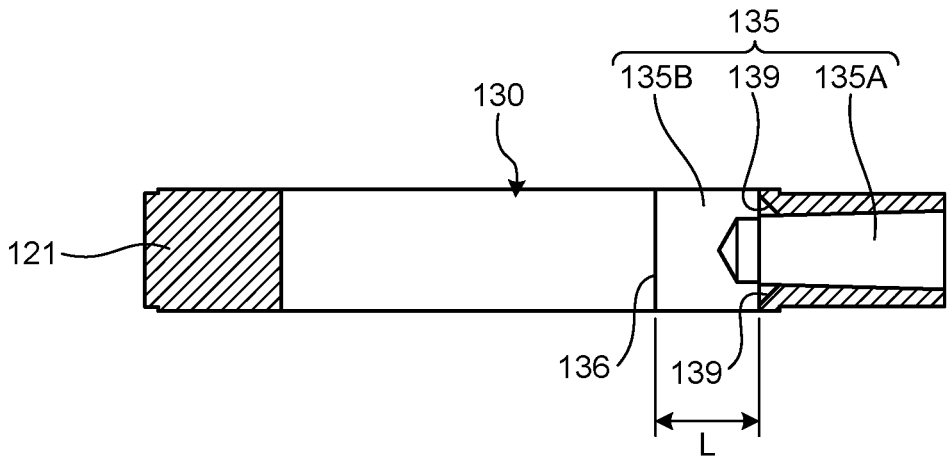
FIG. 8 is a longitudinal sectional view that illustrates a suction passage in a rotary compressor according to a modification 4.
Figure 9:
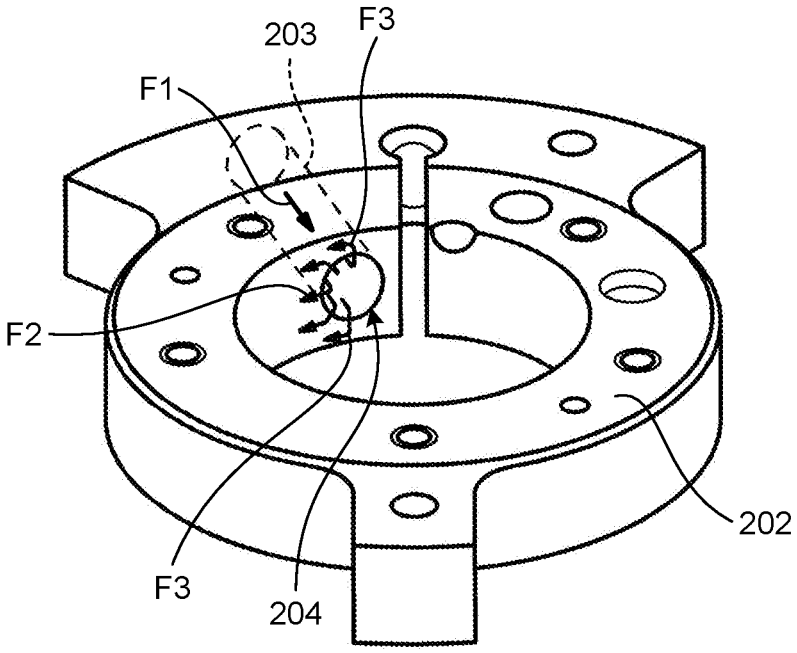
FIG. 9 is a perspective view that illustrates the flow of a refrigerant when it is suctioned into a cylinder through a suction hole in a rotary compressor according to a related technology.

FIG. 5 is a plan view that illustrates, from above, the cylinder 121, the piston 125, and the vane 127 in a rotary compressor according to a modification 1. FIG. 6 is a plan view that illustrates, from above, the cylinder 121, the piston 125, and the vane 127 in a rotary compressor according to a modification 2. FIG. 7 is a plan view that illustrates, from above, the cylinder 121, the piston 125, and the vane 127 in a rotary compressor according to a modification 3. FIG. 8 is a longitudinal sectional view that illustrates a suction passage in a rotary compressor according to a modification 4.

(Modification 1)

According to the above-described embodiment, the width of the second passage 135B from its one end to the other end in the circumferential direction of the cylinder 121, is the same, i.e., it is formed to be straight with the same width in the radial direction of the cylinder 121; however, it may be not only straight (W1=W2) but also tapered (W1<W2) as illustrated in FIG. 5 as long as Equation 2 (W1≤D1×0.7) and Equation 3 (W2≤D1) are satisfied. By tapering the downstream side (the side of the opening 136) of the second passage 135B with respect to the flow of the refrigerant, it is possible to reduce the amount of refrigerant flowing back to the suction passage 135 more effectively, the refrigerant being temporarily supercharged into the suction chamber 131 in the middle of being suctioned into the cylinder 121, whereby the compression efficiency of the rotary compressor 1 may be improved. Furthermore, according to the modification 1, in the same manner as the embodiment, a pressure loss occurring in the suction passage 135 when the refrigerant is suctioned, is reduced, and the compression efficiency of the rotary compressor 1 may be improved.

(Modification 2)

Furthermore, according to the above-described embodiment, the edge surface of the second passage 135B at one end is formed to be straight (flat surface); however, it may be formed to be circular (curved surface) as illustrated in FIG. 6. The circular shape of the second passage 135B formed at one end, enables cutting processing on the second passage 135B by using an end mill.

(Modification 3)

Furthermore, as illustrated in FIG. 7, when the circle forming one end side of the second passage 135B has a diameter D2, it is considered that the diameter D2 corresponds to the width W2 at one end side of the second passage 135B; therefore, Equation 3 is replaced with D2≤D1, and the diameter D2 of the circle may be larger than the width of a slit portion S of the second passage 135B within the range in which D2≤D1 is satisfied. Making the diameter D2 of the circle forming one end side of the second passage 135B larger than the width of the slit portion S of the second passage 135B, facilitates broaching processing as the circular portion serves as a back clearance when the slit portion S of the second passage 135B is formed by broaching processing.

(Modification 4)

As illustrated in FIG. 8, the suction passage 135 in the rotary compressor according to the modification 4, is provided with chamfered portions 139 at one end of the first passage 135A on the side of the second passage 135B so that they have a tapered shape such that their widths become gradually larger in the vertical direction of the first passage 135A (the axial direction of the rotary shaft 15) toward the upper side and the lower side of the cylinder 121.

In the suction passage 135, if the cross-sectional area of the flow passage is rapidly enlarged at the connection point between the first passage 135A and the second passage 135B in the vertical direction of the cylinder 121 (the axial direction of the rotary shaft 15), the flow of the refrigerant is disordered, and a pressure loss occurs due to the disordered flow. Therefore, the first passage 135A according to the modification 4, is provided with the chamfered portion 139 at one end connected to the second passage 135B so that the flow path in the suction passage 135 is gradually enlarged in the vertical direction of the cylinder 121, whereby the occurrence of disturbance of the refrigerant flowing in the suction passage 135, may be further prevented. This may further reduce a pressure loss occurring in the suction passage 135 when a refrigerant is suctioned, and the compression efficiency of the rotary compressor 1 may be further improved.

In the same manner as the embodiment, the second passage 135B according to any one of the above-described modifications 1 to 4, is formed at a position far from the side surface 128A of the vane groove 128 toward the suction passage 135 with the central angle θ of equal to or more than 30° and it is ensured that the thickness between the vane groove 128 and the second passage 135B is an appropriate thickness.

The present invention is not limited to the embodiment and the modifications, and it is also applicable to, for example, a two-cylinder type rotary compressor including two cylinders arranged with an intermediate divider corresponding to an end plate, which covers the cylinder, interposed therebetween. In the two-cylinder type rotary compressor, the refrigerant suctioned to the side of one of the cylinders during suctioning, tends to be pulled to the side of the other one of the cylinders during compression due to the pressure through the accumulator, and the refrigerant suctioned into the suction chamber, easily flows back through the suction passage. Therefore, when the configuration related to the suction passage 135 according to the embodiment and the modifications described above, is applied to a two-cylinder type rotary compressor, there are more advantages as compared to a one-cylinder type rotary compressor.

Although the embodiment is explained above, the embodiment is not limited to the above-described details. Furthermore, the above-described components include the ones easily developed by a person skilled in the art, substantially the same ones, and the ones within what is called the range of equivalents. Furthermore, the above-described components may be combined as needed. Moreover, at least one of various types of omission, replacement, and modification, may be made to components without departing from the scope of the embodiment.

EXPLANATION OF REFERENCE

1 ROTARY COMPRESSOR
10 COMPRESSOR CHASSIS
11 MOTOR
12 COMPRESSION UNIT
15 ROTARY SHAFT
105 SUCTION TUBE (SUCTION UNIT)
107 DISCHARGE TUBE (DISCHARGE UNIT)
111 STATOR
112 ROTOR
121 CYLINDER
121A INNER CIRCUMFERENCE
125 PISTON
127 VANE
128 VANE GROOVE
128A SIDE SURFACE
130 CYLINDER CHAMBER
131 SUCTION CHAMBER
133 COMPRESSION CHAMBER
135 SUCTION PASSAGE
135A FIRST PASSAGE
135B SECOND PASSAGE
136 OPENING
137 CONNECTION THROUGH-HOLE
138 TILTED FACE
139 CHAMFERED PORTION
151 SUB-SHAFT PORTION
152 ECCENTRIC PORTION
153 MAIN SHAFT PORTION
160T UPPER END PLATE (END PLATE)
160S LOWER END PLATE (END PLATE)
161T MAIN-SHAFT BEARING PORTION
161S SUB-SHAFT BEARING PORTION
190 DISCHARGE HOLE
D1 INNER DIAMETER
Dc INNER DIAMETER
Dp OUTER DIAMETER
L LENGTH
W1, W2 WIDTH
θ CENTRAL ANGLE

The invention claimed is:

1. A rotary compressor comprising:

a longitudinally-mounted sealed cylindrical compressor chassis that is provided with a discharge unit for a refrigerant in an upper section thereof and provided with a suction unit for the refrigerant in a lower section thereof;

a compression unit that is disposed in the lower section of the compressor chassis to compress the refrigerant suctioned from the suction unit and discharge the refrigerant through the discharge unit; and a motor that is disposed in the upper section of the compressor chassis to drive the compression unit, the compression unit including a circular cylinder;

end plates that cover an upper side and a lower side of the cylinder, respectively;

a rotary shaft that includes an eccentric portion and that is rotated by the motor;

a piston that is engaged with the eccentric portion and orbitally moved along an inner circumference of the cylinder to form a cylinder chamber in the cylinder;

a vane that protrudes from a vane groove provided in the cylinder into the cylinder chamber and that is brought into contact with the piston to divide the cylinder chamber into a suction chamber and a compression chamber; and a suction passage for the refrigerant, which is provided in the cylinder by extending in a radial direction of the cylinder and which communicates with the suction unit, the suction passage includes a first passage that is cylindrical and connected to the suction unit; and a second passage whose one end is connected to the first passage and other end has an opening on the inner circumference of the cylinder, and the second passage is formed, from the one end to the other end, in a slit-like shape penetrating the upper side and the lower side of the cylinder, and satisfies $L \geq W1$, $W1 \leq D1 \times 0.7$, $W2 \leq D1$ where a width of the second passage at the other end in a circumferential direction of the cylinder is W1, the width of the second passage at the one end is W2, a length of the second passage from the one end to the other end is L, and an inner diameter of the first passage at an area connected to the second passage is D1.

2. The rotary compressor according to claim 1, wherein the width W1 of the second passage satisfies $[(Dc-Dp)\times 0.3] \leq W1 \leq [(Dc-Dp)\times 0.7]$ where an inner diameter of the cylinder is Dc and an outer diameter of the piston is Dp.

3. The rotary compressor according to claim 1, wherein one end of the first passage at a side of the second passage is provided with a chamfered portion toward the upper side and the lower side of the cylinder such that the first passage is gradually enlarged.

4. The rotary compressor according to claim 1, wherein the second passage is formed at a position away from a side surface of the vane groove at a side of the suction passage toward the suction passage with a central angle of equal to or more than 30° with an intersection point between the side surface at the side of the suction passage and the inner circumference of the cylinder as a center on a plane perpendicular to an axial direction of the rotary shaft.

5. The rotary compressor according to claim 1, wherein the second passage has a tapered portion which satisfies W1<W2.

* * * * *